US009320940B2

(12) United States Patent
Rainey

(10) Patent No.: US 9,320,940 B2
(45) Date of Patent: Apr. 26, 2016

(54) MUSCULAR TRAINING DEVICE, SYSTEM AND METHOD

(71) Applicant: Shanti Rainey, Minneapolis, MN (US)

(72) Inventor: Shanti Rainey, Minneapolis, MN (US)

( * ) Notice: Subject to any disclaimer, the term of this patent is extended or adjusted under 35 U.S.C. 154(b) by 233 days.

(21) Appl. No.: 13/872,264

(22) Filed: Apr. 29, 2013

(65) Prior Publication Data

US 2013/0288866 A1 Oct. 31, 2013

Related U.S. Application Data

(60) Provisional application No. 61/639,550, filed on Apr. 27, 2012.

(51) Int. Cl.

| | |
|---|---|
| ***A63B 26/00*** | (2006.01) |
| ***A63B 22/16*** | (2006.01) |
| ***A63B 22/18*** | (2006.01) |

(52) U.S. Cl.

CPC ..... *A63B 26/003* (2013.01); *A63B 22/18* (2013.01); *A63B 2225/62* (2013.01)

(58) Field of Classification Search

CPC ..... A63B 26/003; A63B 22/18; A63B 22/16; A63B 2022/0033; A63B 2208/0204; A63B 22/14; A63B 23/1236; A63B 23/085; A63B 2225/62; A63B 21/1469; A63B 2208/0214

USPC ..... 482/44–46, 49, 140–142, 145–146, 148

See application file for complete search history.

(56) References Cited

U.S. PATENT DOCUMENTS

| | | | | |
|---|---|---|---|---|
| 1,545,437 | A * | 7/1925 | Malone et al. | 36/7.8 |
| 3,024,021 | A | 3/1962 | Coplin et al. | |
| 3,423,852 | A * | 1/1969 | Smith | 36/7.5 |
| 4,605,224 | A | 8/1986 | Torii | |
| 4,893,809 | A * | 1/1990 | Blankenzee | 482/77 |
| 5,048,823 | A * | 9/1991 | Bean | 482/146 |
| 5,613,690 | A | 3/1997 | McShane et al. | |
| 5,643,154 | A * | 7/1997 | Awbrey et al. | 482/111 |
| 5,897,474 | A * | 4/1999 | Romero | 482/146 |
| 6,019,712 | A | 2/2000 | Duncan | |
| 6,422,983 | B1 | 7/2002 | Weck | |
| 6,461,285 | B1 * | 10/2002 | Theunissen et al. | 482/146 |
| 6,551,225 | B1 * | 4/2003 | Romero | 482/146 |
| 6,575,885 | B1 | 6/2003 | Weck et al. | |
| 7,137,938 | B2 | 11/2006 | Gottlieb | |
| 7,300,392 | B1 | 11/2007 | Curran | |
| 7,344,488 | B2 | 3/2008 | Weck et al. | |
| 7,374,517 | B2 * | 5/2008 | Lockett | 482/131 |
| 7,494,446 | B2 | 2/2009 | Weck et al. | |
| 7,601,107 | B2 * | 10/2009 | Maloy et al. | 482/123 |
| 7,632,218 | B2 * | 12/2009 | Sannes et al. | 482/51 |
| 7,775,952 | B1 | 8/2010 | Curran et al. | |
| 7,806,807 | B2 | 10/2010 | Genua | |

(Continued)

*Primary Examiner* — Loan H Thanh

*Assistant Examiner* — Andrew S Lo

(74) *Attorney, Agent, or Firm* — Shewchuk IP Services, LLC; Jeffrey D. Shewchuk

(57) ABSTRACT

An exercise device includes a relatively rigid platform supported by a compressible base. The base has a central flat and then slopes outward and upward from the central flat in a spherical section. The base permits instability in height, angle, and shear strain movement. The user performs postures and/or exercises using the exercise device under each appendage being used for support. The instability triggers the Golgi tendon receptor and the muscle spindle receptor and thereby achieves physiological benefits. The muscular training devices come in different sizes and configurations to make up a muscular training system.

18 Claims, 8 Drawing Sheets

(56) References Cited

U.S. PATENT DOCUMENTS

| | | | | |
|---|---|---|---|---|
| D627,015 | S | 11/2010 | Senegal | |
| 8,105,218 | B1 * | 1/2012 | Vayntraub | 482/141 |
| 8,105,220 | B2 * | 1/2012 | Schultheisz | 482/146 |
| D660,928 | S | 5/2012 | Guarrasi | |
| 8,357,077 | B2 | 1/2013 | Taylor et al. | |
| D724,162 | S * | 3/2015 | James | D21/688 |
| 2004/0087421 | A1 * | 5/2004 | Lin | 482/146 |
| 2004/0198573 | A1 * | 10/2004 | Brydson et al. | 482/146 |
| 2005/0245372 | A1 * | 11/2005 | Mylrea et al. | 482/148 |
| 2006/0014615 | A1 * | 1/2006 | Godbold | 482/141 |
| 2006/0035771 | A1 * | 2/2006 | Gant | 482/141 |
| 2006/0211553 | A1 * | 9/2006 | Cantor | 482/146 |
| 2007/0207901 | A1 * | 9/2007 | Traub | 482/52 |
| 2007/0298947 | A1 * | 12/2007 | Eksteen | 482/141 |
| 2009/0215596 | A1 * | 8/2009 | Obermaier | 482/142 |
| 2010/0279833 | A1 * | 11/2010 | Gant | 482/141 |
| 2010/0331154 | A1 * | 12/2010 | Taylor et al. | 482/142 |
| 2011/0237412 | A1 * | 9/2011 | Signorile et al. | 482/142 |
| 2012/0258841 | A1 * | 10/2012 | James | 482/91 |
| 2013/0184131 | A1 * | 7/2013 | Doyle, Brian | 482/139 |
| 2013/0252217 | A1 * | 9/2013 | Grzesiak et al. | 434/258 |
| 2013/0316886 | A1 * | 11/2013 | Lynch et al. | 482/146 |
| 2014/0162858 | A1 * | 6/2014 | Dalebout | 482/142 |

* cited by examiner

MUSCULAR TRAINING DEVICE, SYSTEM AND METHOD

CROSS-REFERENCE TO RELATED APPLICATION(S)

The present application claims priority from U.S. Provisional Application No. 61/639,550 entitled MUSCULAR TRAINING DEVICE, SYSTEM AND METHOD, filed Apr. 27, 2012, incorporated herein by reference.

FIELD OF THE INVENTION

The present invention relates to physical fitness and muscular training, and particularly to devices used to enhance muscular training and exercising, which devices are provided as part of a system and used in a method to obtain better results from such muscular training and exercising.

BACKGROUND OF THE INVENTION

Exercising and sport have been practiced for millennia, and there are legions of devices which are utilized to enhance such exercising and physical training for sport. It has long been accepted that weight training has beneficial physiological effects on the body.

Muscle groups can be classified into three groups: primary movers, stabilizers (secondary), and neutralizers (tertiary)—in which, their responsibility and role changes based on the body's orientation. When the body is young, it has a natural propensity to call upon and fire most of our muscles—giving us a great sense of balance. As we age, it becomes increasing more difficult to access and recruit the vital secondary and tertiary muscle systems.

As a general statement, most training devices are directed at strength of large muscle groups (weights, etc.) and/or timing of large physical actions (sport training devices), with relatively fewer devices directed at balance and the coordination of the secondary or tertiary muscles used in balance relative to the larger muscle groups. Within the category of balance enhancing devices, some devices incorporate rolling balance by virtue of a curved or spherical profile. In some sports, such as surfing or skateboarding, balance is practiced and achieved on a relatively unstable device through two points of human contact, i.e., by balancing with two feet on a surfboard.

The exact physical phenomenon which occurs in muscles to achieve balance is the subject of considerable study. Within each human body there are countless sensory receptors which are constantly monitoring our orientation and our interaction to the environment. Moreover, there is a proprioceptive sensory system designed to detect when the body is under tension or pressure, such as when holding a dumbbell during weight training. The firing of various muscles to keep and maintain balance occurs far too quickly for conscious awareness, and instead occurs reflexively. Part of the balance reflex arc includes the Golgi tendon, a proprioceptive receptor which is located within the tendons found on each end of a muscle. The Golgi tendon is stimulated by a quick change in tension on a muscle, to begin the reflexive arc for additional muscles to fire to restore balance.

The muscle spindle has a distinct sensory responsibility—that is to monitor the change in length of the muscle and soft tissue. More specifically, this receptor is designed to sense the "rate of change" in respect to length of the muscle. The muscle spindle is best stimulated during a sudden, almost unexpected, involuntary and quick movement. Thus—when a very quick movement is applied to the body—likely for the body to lose equilibrium and balance—a profound counter response is elicited in hopes of restoring balance. Triggering the muscle spindle receptor causes significant and high levels of muscle recruitment and muscle engagement to occur—especially the important and vital secondary and tertiary muscles.

While the science concerning large muscle strength exercises (using weights or other resistance against large muscle contraction) is relatively mature, the science of what exercises to perform and what devices to use to perform those exercises to specifically trigger the Golgi tendon receptor and the muscle spindle receptor—for physiological benefit rather than for sport (such as surfing) performance—is in its infancy.

SUMMARY

The present invention is directed at a series of muscular training devices which are specifically designed to trigger the Golgi tendon receptor and the muscle spindle receptor and thereby achieve physiological benefits. The muscular training devices come in different sizes and configurations to make up a muscular training system, which is coupled with a method of performing exercises using one such device under each appendage being used for support (i.e., a different exercise device for each hand or foot used to support the weight of the user). Each exercise device includes a relatively rigid platform supported by a compressible base. The base has a central flat and then slopes outward and upward from the central flat. The shape and the compressibility of the base both contribute to make the platform unstable during use.

While the above-identified drawing figures and text set forth preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 1:
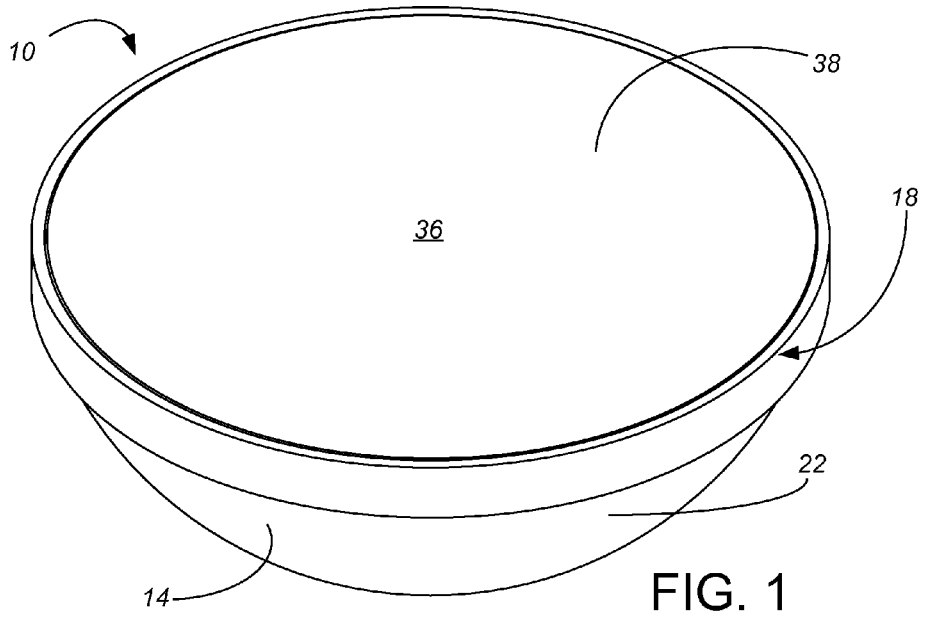
FIG. 1 shows a perspective view of a muscular training device (3/8$^{th}$ sphere activator) in accordance with the present invention.
Figure 2:
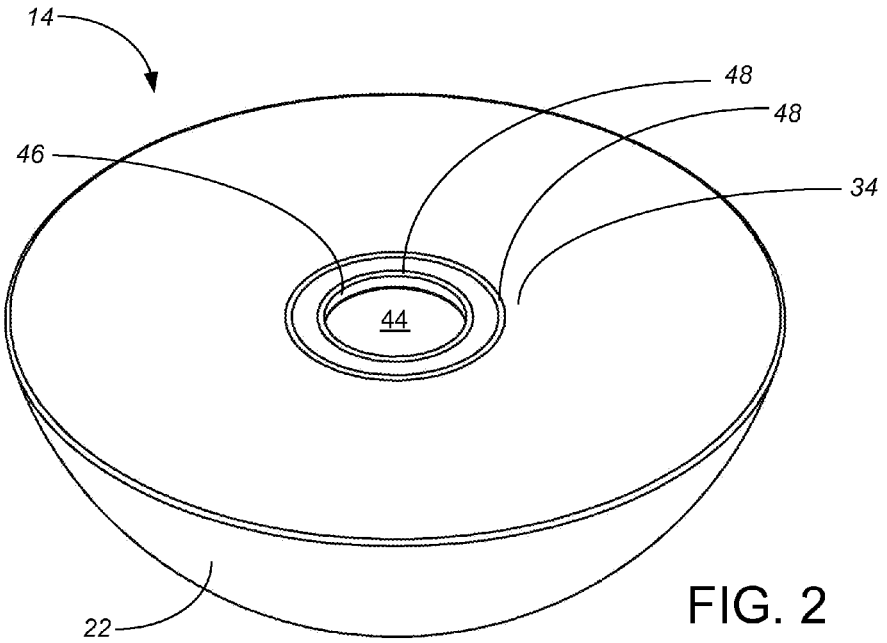
FIG. 2 is a perspective view of the compressible support used in the muscular training device of FIG. 1.
Figure 3:
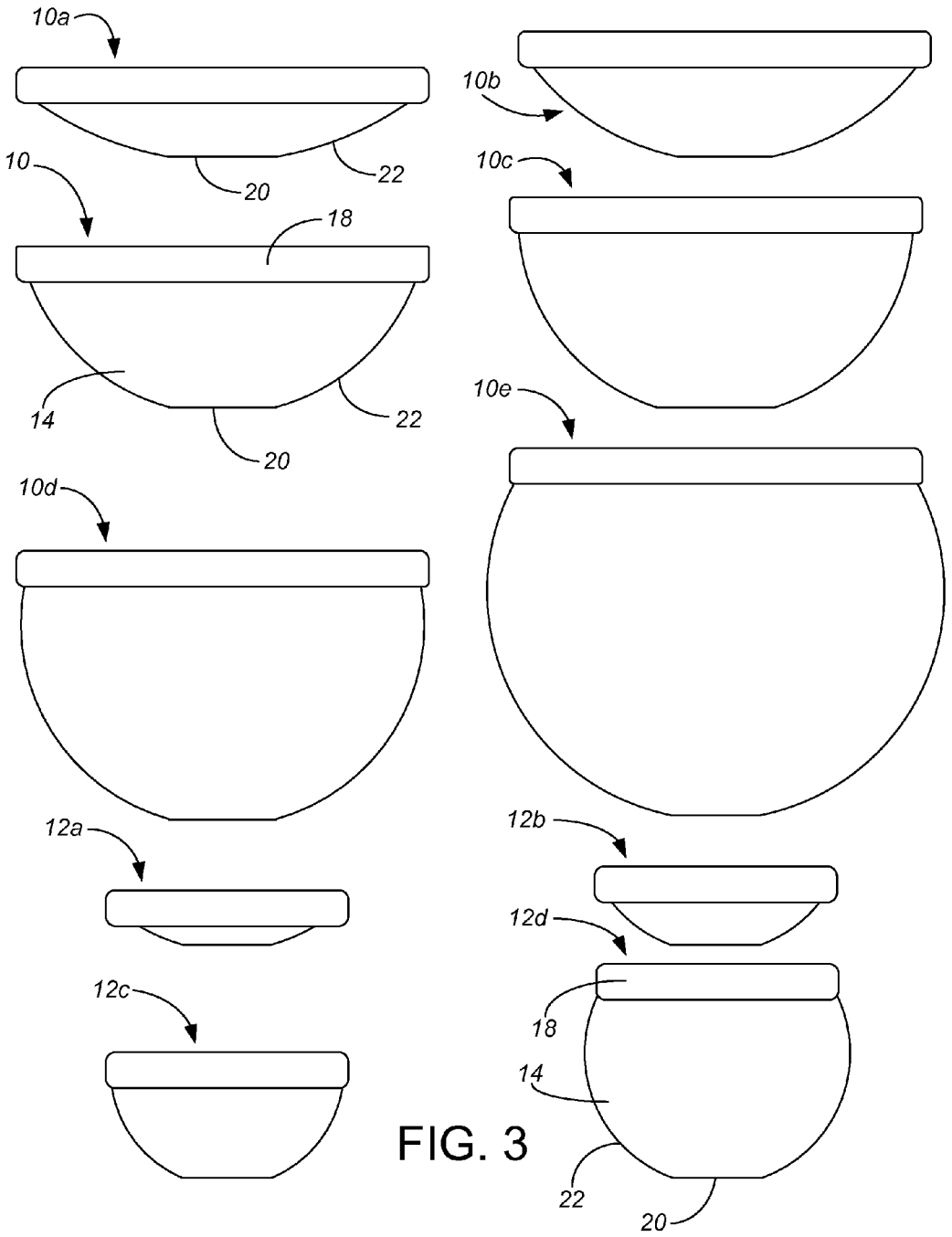
FIG. 3 is a side view, showing the relative sizes of the preferred muscular training devices of the present invention.
Figure 4:
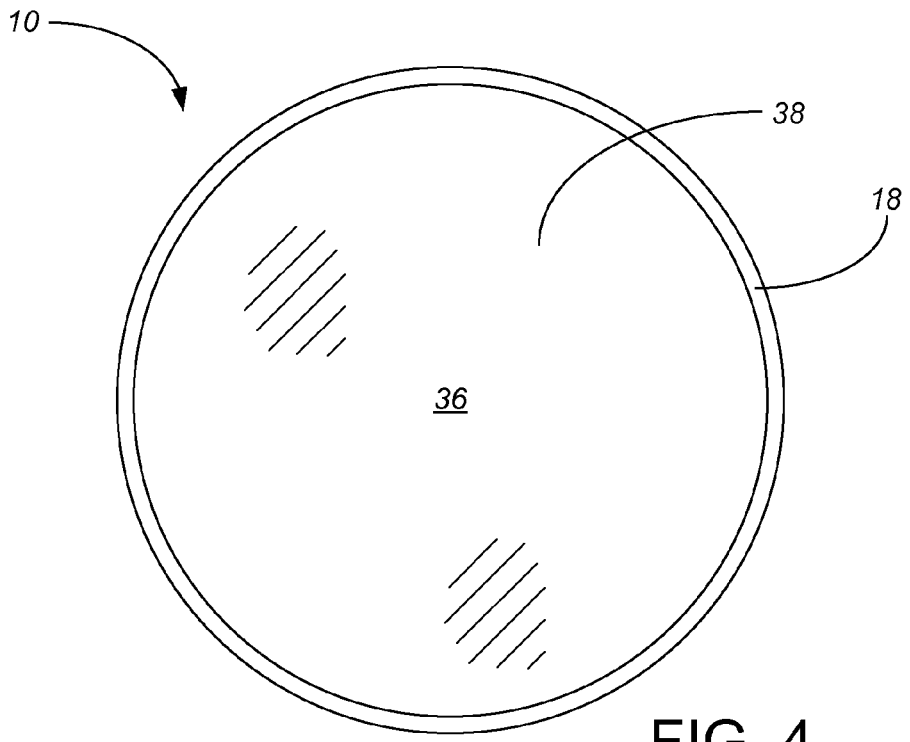
FIG. 4 is a top view of the muscular training device of FIG. 1.
Figure 5:
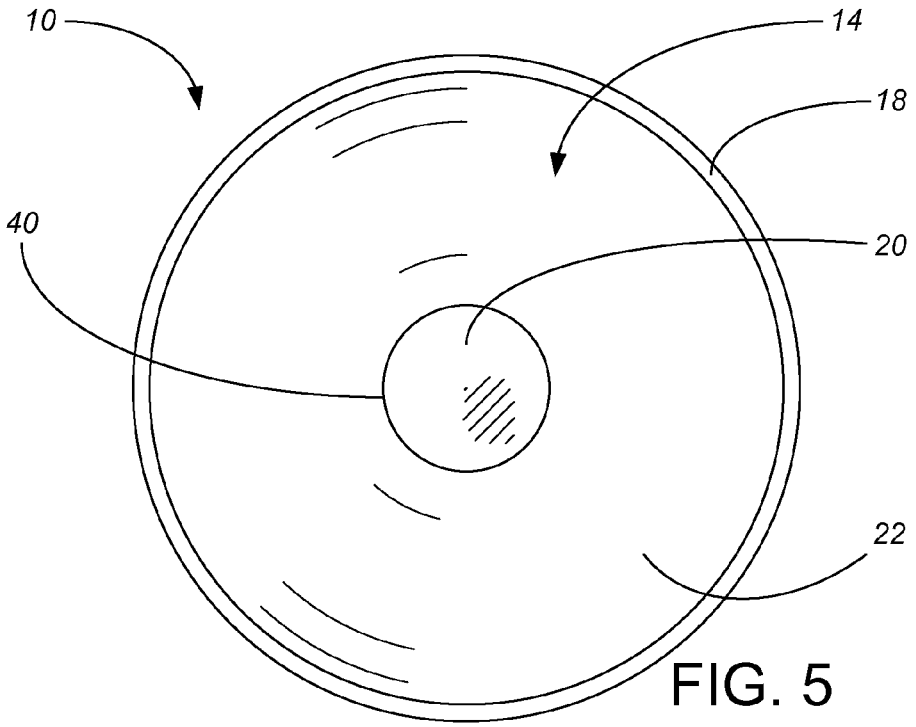
FIG. 5 is a bottom view of the muscular training device of FIGS. 1 and 4.
Figure 6:
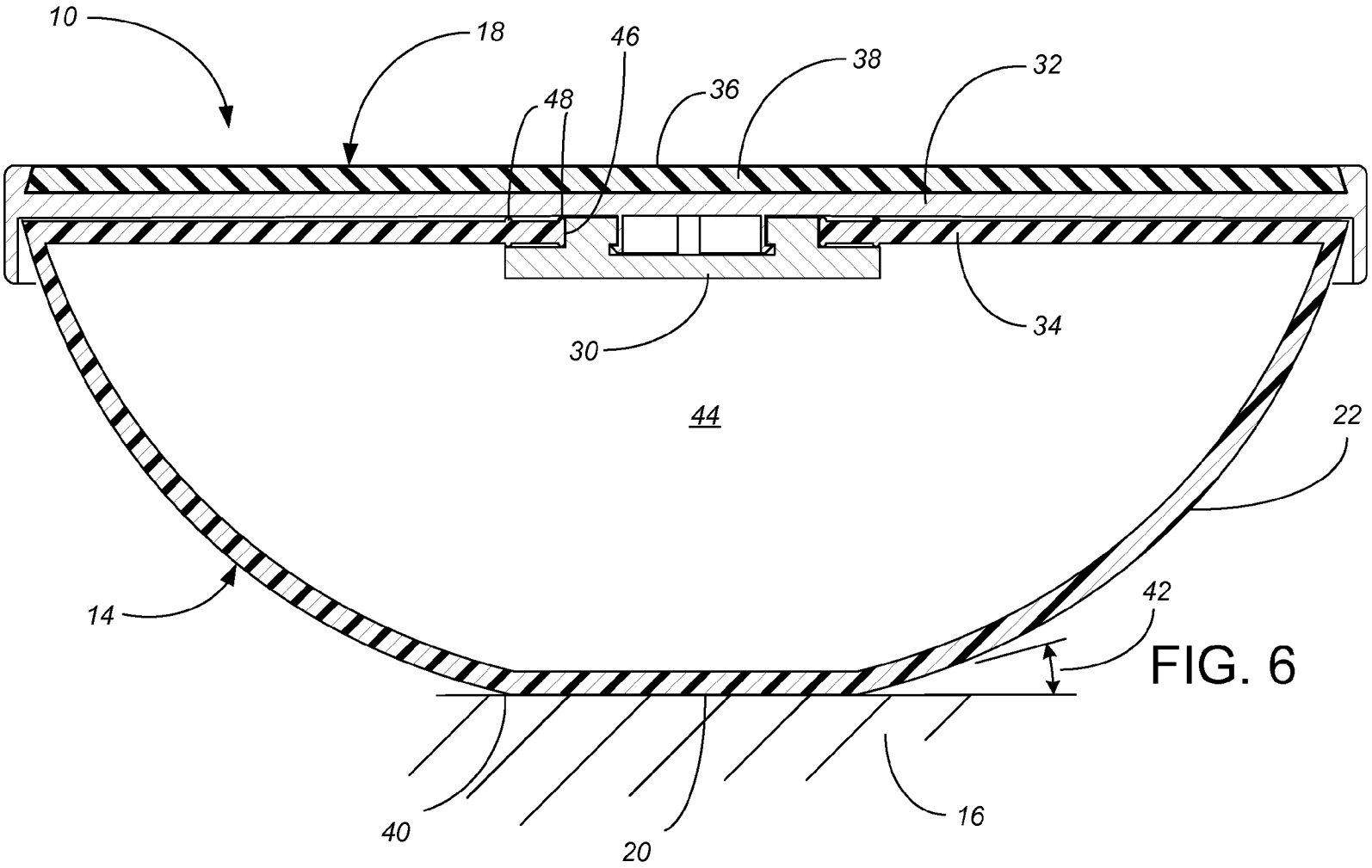
FIG. 6 is a cross-sectional view, taken along lines 6-6, of the muscular training device of FIGS. 1, 4 and 5.

A preferred embodiment of an exercise device 10 in accordance with the present invention, in this case a 3/8 sphere, 12 inch platform activator, is shown in FIGS. 1, 2 and 4-7, and is one of the exercise devices 10*a*, 10*b*, 10, 10*c*, 10*d*, 10*e*, 12*a*, 12*b*, 12*c*, 12*d* shown in FIG. 3. The common elements of this progression of exercise devices 10*a*, 10*b*, 10, 10*c*, 10*d*, 10*e*, 12*a*, 12*b*, 12*c*, 12*d* will be described only with reference to the ⅜ sphere activator 10, it being understood that the remaining exercise devices 10*a*, 10*b*, 10*c*, 10*d*, 10*e*, 12*a*, 12*b*, 12*c*, 12*d* can all have a similar construction modified for their particular size or configuration.

Each exercise device 10 includes two primary components, a compressible base 14 which makes contact with the floor 16, and a relatively rigid platform 18 attached over the compressible base 14. While different sizes of platforms 18 can be used, each exercise device 10 is intended for a single appendage of human support, i.e., for a single hand or foot, or for another single point of support bearing the weight of the user, such as an elbow, forearm, hip, or knee. For most exercises, the exercise device 10 will be used for a single hand or a single foot, because the instability benefits of the present invention are best enjoyed by the secondary and tertiary muscles associated with balancing control of the hands and feet.

The compressible base 14 has a horizontally-extending flat 20 on its bottom surface. The flat 20 is important for maintaining a balanced, upright position of the exercise device 10, both before being loaded (when the user first places the exercise device 10 on the ground) and after being loaded (when the user places some or all of his or her body weight on the platform 18). The flat 20 needs to be large enough for a user to easily identify the flat 20 and use the flat 20 to balance the device 10, but should be significantly smaller than the overall width of the exercise device 10. For example, the flat 20 should be at least one inch wide. For the smallest exercise devices (not shown, when the platform 18 is at least 4 inches wide), the preferred size of the flat 20 is up to half the width of the exercise device 10, or within the range of about 1 to 2 inches wide. For larger exercise devices 10 (when the platform 18 can be 12, 14 or 16 inches wide), the flat 20 should remain smaller than the footprint or handprint on the platform 18, i.e., a flat size no greater than about 4 inches wide, with a preferred size of about 2 or 2½ inches wide. In the preferred embodiment, the flat 20 is circular, located exactly in the center of the device 10, i.e., the central axis of the flat 20 coincides with the central axis 50 of the platform 18.

Around the flat 20, the compressible base 14 angles upward and outward from the flat 20 in a sloped surface 22 having a curved configuration. Many benefits of the present invention could be achieved with the sloped surface 22 having a plurality of distinct sides meeting at edges, such as six, eight or more sides each sloping upward and outward from the flat 20. If separate sides are defined, there should be enough sides that users can and often do change which side contacts the floor 16 during use of the device 10, i.e., the curved sides should collectively permit simultaneous pitch and roll instability to the exercise device 10 during use of the device 10. The preferred embodiment has the sloped surface 22 curving continuously in both plan view and side view. Because of this three dimensional curvature, the sides 22 permit simultaneous and continuous pitch and roll instability to the exercise device 10. While the curvature could be oval or egg shaped, for simplicity of construction the preferred sloped surface 22 is a spherical section between the flat 20 and the platform 18. As a spherical section, the sloped surface 22 has a slope which increases as distance from the central flat 20 increases. Future testing may in fact show that a varying rate of curvature as the sloped surface 22 gets further from the flat 20 (i.e., oval in side view) provides additional benefits. Future testing may alternatively show that a varying rate of curvature in the circumferential direction (i.e., oval in plan view) provides additional benefits. At this time, the spherical section profile of the sloped surface 22 has already been found to produce wonderful exercising results in working secondary and tertiary muscles.

The compressible base 14 is formed of a material and/or construction which enables it to have significant compression under the load placed on it by a normal user. For instance, when the platform 18 is loaded with a force of 200 lbs, the base 14 should compress by a distance which can be perceived by the user, such as ⅛ of an inch or more. In the cross-sectional view of FIG. 7, this vertical compressibility is shown by dimension 24, because the center of the platform 18 is significantly lower after the device 10 has been loaded. The preferred embodiment provides a vertical compression 24 of about ⅜ inch under a 40 lb loading force.

As or more significant as the overall vertical compression 24 of the base 14, the material and/or construction of the base 14 should permit an angular compressibility. For instance, when the platform 18 is loaded with a force of 200 labs in the vertical direction but off-center, it should allow the platform 18 to angle at least 1° to horizontal while keeping the entire flat 20 on the horizontal floor 16. In the cross-sectional view of FIG. 7, this angular compressibility is shown by angle 26, because angle of the platform 18 can be significantly out of horizontal after the device 10 has been loaded. In the preferred embodiment, the load of a hand or a foot can change the angle 26 of the platform 18 by 5° or more without having the flat 20 leave the floor 16.

A third aspect to the compressibility of the base 14 is a horizontal shear strain type of movement. That is, in the preferred embodiment not only can loading of the platform 18 result in vertical and angular compression of the platform 18 relative to the flat 20, but loading of the platform 18 can also result in a horizontal movement of the platform 18 relative to the flat 20 without the flat 20 losing traction or sliding on the floor 16. This shear type of movement is shown by the dimension 28 in FIG. 7. The preferred embodiment permits a shear strain type of movement of at least 0.1 inches during exercising use of the device 10. This shear strain type of movement is most commonly witnessed as the platform 18 shakes back and forth (side-to-side, or front-to-back) during use of the device 10.

Beyond the existence of vertical compressibility, angular compressibility and the shear strain type of movement is the fact that the material and/or construction of the base 14 must be able to spring back from any vertical, angular or shear strain compression in an essentially instantaneous time frame. During use of the device 10, all three types of instability occur without the flat 20 moving relative to the floor 16. During use of the device 10, the compressibility springs back faster than the user's muscles move (faster than a foam cushion or pad, which leave an indentation for a short period of time), with no perceivable time delay.

In contrast to the compressibility of the base 14, the platform 18 is formed of a strong, relatively rigid material, of sufficient thickness that it does not significantly bend or deform during use. The platform 18 is joined to and horizontally covers the compressible base 14. While the platform 18 could be formed of metal, in the preferred stationary platform configurations it is molded of a strong rigid thermoplastic to provide a low cost, light weight construction.

The platform 18 is intended for a single appendage of stabilizing support, i.e., a single hand, foot, knee, elbow etc. While the platforms 18 could have one or more flats (not shown) on their sides (such as being octagonal) or otherwise have a non-circular shape (in plan view), the preferred constructions are equally balanced and unstable in all directions, provided by circular platforms 18. If the platforms are non-circular (not shown), the non-circularity should be minimal and not sufficient to provide a particular direction to the device 10. That is, the platform 18 should have a shape which provides substantially equal pitch and roll instability, both perceptively to the user and physically to the balance of the device 10. For instance, a high degree of non-circularity so to suggest that two appendages of support (such as two feet) should be used on the platform would be outside the present invention.

Figure 7:
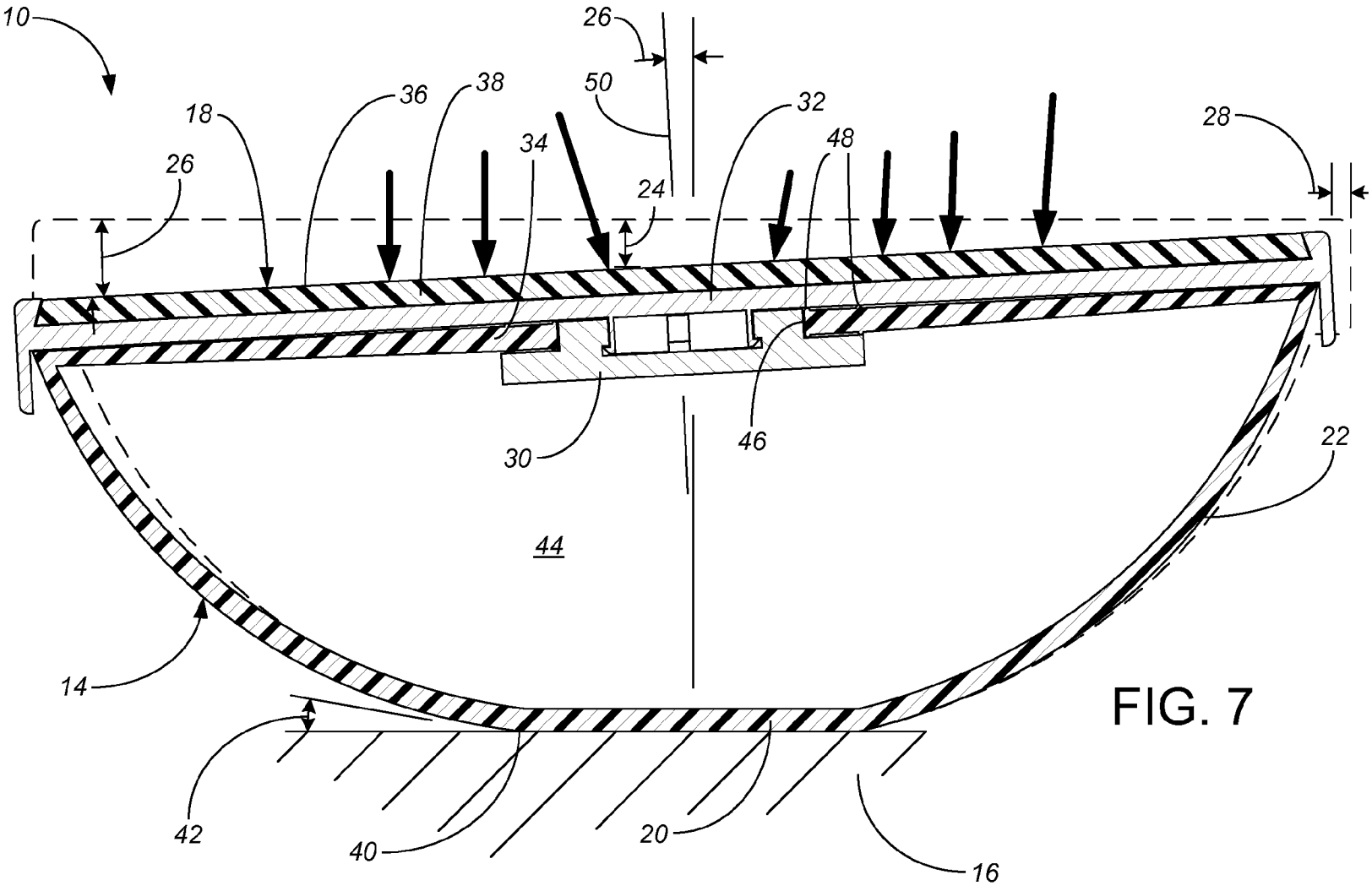
FIG. 7 is the cross-sectional view of FIG. 6, shown as compressed during use.

While the platform 18 is intended for a single appendage of stabilizing support, it should be understood that there are typically multiple different locations on that single appendage of stabilizing support which place forces on the platform 18. For instance, when a hand is used for stabilizing support, each of the fingers, the thumb and the palm place essentially distinct forces onto the platform 18. Accordingly, FIG. 7 shows arrows of differing magnitudes and slightly different directions loading the device 10, with each different arrow intending to represent the force delivered by a single finger, thumb or palm. The secondary and tertiary muscles which determine and change the magnitudes and directions of these multitude of forces fire rapidly and unconsciously as the user tries to maintain balance and stability on the device 10.

Different sizes of platforms 18 are used for different levels of expertise in performing exercises, with larger platforms more commonly used for a foot and smaller platforms more commonly used for a hand. The size of the platform 18 should be at least 3 inches wider than the central flat 20. In the preferred system, platform sizes of 4 and 6 inch diameter include permanently attached bases, while platform sizes of 8, 10, 12, 14 and 16 inch diameter (to fit even the largest athlete's foot) are removably connected to the bases, so different sized bases can be used with different sizes of platforms. In the preferred embodiment, the platform 18 includes a lower push insert 30 (shown in FIG. 7) which detachable joins to an upper plate 32 around an inwardly extending lip 34 of the base 14. While the preferred embodiment has a flat or planar platform 18 so as to be equally applicable for use with the hand, foot, knee, elbow or hip, the platform 18 could alternatively include some sort of handle or graspable handhold for use only with a hand.

The platform 18 preferably includes a traction surface 36 on its top, which can be provided by one of several interchangable traction inserts 38 (see FIG. 7, only one shown). The preferred traction insert 38 has a non-slip flat top surface 36, such as a tacky or roughened surface finish so the user does not slip or shift out of the originally intended body position. This will aid in providing safety for the user. A first alternative traction insert (not shown) is formed of a compressible material such as foam or padding to increase softness or comfort to the hand, foot, elbow, knee or hip placed there. A second alternative traction insert (not shown) is formed with a contained gel like material, again to increase comfort to the hand, foot, elbow, knee or hip placed there. Note with either the compressible or gel-containing traction insert, the platform 18 still provides underlying rigidity, i.e., the traction insert typically does not respond fast enough, and the underlying support base 14 provides substantially all of the instability of the platform 18. The purpose of the compressible or gel-containing traction insert is to provide a soft tactile experience that is comfortable, designed to absorb and disperse force tension. Other alternative materials for the traction inserts are sports surfaces, such as artificial grass or basketball hardwood, and myofascial release/massage type surfaces designed with bumps, ridges or knobs.

The edge defining the flat 20 provides a rim 40. During use of the device 10, the platform 18 tends to have an unstable position relative to the flat 20, in three different regimes depending upon how much of the rim 40 contacts the floor 16. An initial level of instability is provided by the vertical compressibility, angular compressibility and the shear strain type of movement without the flat 20 moving from its position on the floor 16. The platform 18 tends to shake, mostly in angle and horizontal position, as the user attempts to stabilize using secondary or tertiary muscle groups which must be fired very quickly to prevent the platform 18 from becoming more unstable. As a user gains familiarity with use of the device 10, the response to this first level of instability is essentially involuntary and unconscious: the user simply tries to maintain the device 10 "steady" with as little shaking as possible, not realizing the muscular working required to do so and not intentionally firing any muscles.

A second, higher level of instability occurs should the flat 20 raise off the floor 16, with the base 14 riding on a portion of the rim 40, but without the sloped surface 22 yet significantly contacting the floor 16. As long as the device 10 is riding on the rim 40, the rim 40 asserts a discrete force tending to directly return the flat 20 to the floor 16, i.e, tending to return the device 10 to its "home" position. How long the device 10 remains on the rim 40 and how large the rim force is depends upon the angle 42 between the flat 20 and the sloped side 22. The preferred devices all have an angle 42 between the flat 20 and the sloped side 22 which is greater than 3°, and more preferably greater than 10°.

A third, even higher level of instability occurs should the device 10 tip past the rim 40 so the curvature of the sloped surface 22 contacts the floor 16. At this higher level of instability, there is no force promoting the "home" position, and thus the construction of the base 14 no longer assists in maintaining a steady position. At this third higher level of instability, typically the user is fully aware that the platform 18 has lost stability in a particular direction or angle, and is consciously working to turn the device 10 so the flat 20 is back on the floor 16. This third level of instability must be corrected prior to the user losing friction on the platform 18, i.e, before the angle of the platform 18 relative to horizontal increases to the extent that the user simply slides off the platform 18 rather than trying through muscular response to level the platform 18. The preferred devices therefore all have an angle between the flat 20 and the sloped side 22 which is less than 45°, and more preferably less than 25°.

While the compressibility of the base 14 could be provided by some sort of spring or possibly by a fast-return foam material, in the preferred embodiment the base 14 is formed of a rubbery, shape retaining, air tight material, filled with an unloaded air pressure. In contrast to the thickness of rubber materials used for playground balls, footballs, basketballs, etc., the preferred base 14 has a greater thickness, such as around 0.25 inch thick molded rubber material. In the preferred embodiment, this material forms a sealed air bladder, having an interior space 44 filled with an air pressure in the range of 2 to 20 psi (depending upon the exact thickness of the wall material and the amount of initial instability desired). For ease of construction and attaching to the platform 18, the base 14 defines an opening 46, with one or more ridges 48 encircling the opening 46. The opening 46 allow the lower push insert 30 and the upper plate 32 to releaseably attach to each other through the opening 46, and the ridges 48 promote an airtight seal between the base 14 and the lower push insert 30 and/or the upper plate 32. Higher air pressures and/or thicker walls tend to result in faster but shorter distance instability of the device 10, while lower air pressures and/or thinner walls tend to result in slower instability of longer distances. In the preferred constructions, it is in fact the air pressure within the base 14 that supports the majority of the load placed on the platform 18. For example, placing a 40 lb load (typical of one hand) on a platform 18 can increase the air pressure within the base 14 from 8 to about 19 psi. As an alternative to the base 14 constructed in a single layer forming an air-filled bladder, an air-filled bladder can be formed separately and positioned and contained within the base 14. Even with a separate air-filled bladder (not shown), the base 14 can still be formed of a flexible rubberized material.

The determination of when the flat 20 raises off the floor 16 and when the sloped surface 22 contacts the floor 16, (i.e., the demarcations between the lower level of instability, the second level of instability and the third, even higher level of instability) depends upon an interplay between numerous design factors in the device 10 relative to the muscular and balance skill of the user. The most primary design factors are the size of the flat 20 and the height of the platform 18 over the flat 20. To prevent the possibility of injury, the height of the platform 18 should be no greater than 10 inches over a bottom surface of the flat 20. The initial angle 42 of the sloped surface 22 also significantly affects the instability response of the device 10. The shape retaining ability, strength and thickness of the material used to form the base 14 and the contained air pressure also affect the instability response of the device 10.

Because the size of the flat 20 and the height of the platform 18 over the flat 20 have such an influence on the instability response of the device 10, the preferred system includes two different sets of progressing sizes of devices 10, with the larger devices being referred to as "activators" and the smaller devices being referred to as "accelerators". As depicted in FIG. 3, all the activators 10*a*, 10*b*, 10, 10*c*, 10*d*, 10*e* are shown with a 12 inch diameter platform 18, while all the accelerators 12*a*, 12*b*, 12*c*, 12*d* sare shown with a 6.8 inch diameter platform 18. The size of the flat 20, the section of the sphere, the size of the sphere, the initial angle 42 of the sloped sides 22 for the preferred progression of devices is as follows:

| Device | Sphere Portion | Flat size (Ø in) | Platform Height (in) | Initial incline angle (°) | Sphere size (Ø in) |
|---|---|---|---|---|---|
| Activator 10a | ⅛ | 2.5 | 2.5 | 10 | 16.3 |
| Activator 10b | ¼ | 2.5 | 3.6 | 14 | 12.6 |
| Activator 10 | ⅜ | 2.5 | 4.6 | 15 | 11.3 |
| Activator 10c | ½ | 2.5 | 5.9 | 16 | 11.0 |
| Activator 10d | ⅝ | 2.5 | 7.4 | 15 | 11.4 |
| Activator 10e | ¾ | 2.5 | 9.9 | 14 | 12.7 |
| Accelerator 12a | ⅛ | 2.0 | 1.7 | 15 | 9.5 |
| Accelerator 12b | ¼ | 2.0 | 2.3 | 19 | 7.4 |
| Accelerator 12c | ½ | 2.0 | 3.6 | 23 | 6.5 |
| Accelerator 12d | ¾ | 2.0 | 5.8 | 19 | 7.4 |

As can be seen, every activator within the progression has a progressively greater height, and every accelerator within the progression has a progressively greater height. Every activator within the progression also has a progressively different initial incline angle 42 or beginning slope immediately adjacent the flat 20.

In the preferred embodiments, all the activators have the same flat size, while all the accelerators have a different, smaller flat size. So, for instance, for a given skill level of the user, the ⅛ sphere activator 10*a* spends a greater percentage of time in first regime instability than the ⅛ sphere accelerator 12*a* due to its larger flat size, even though the ⅛ sphere activator 10*a* has a greater platform height than the ⅛ sphere accelerator 12*a*. At the same time, the ⅛ sphere activator 10 has a lower initial incline 42 than the ⅛ sphere accelerator. The result is that the ⅛ sphere accelerator 12*a* will be more likely to enter the second regime of instability (riding on the rim 40) than the ⅛ sphere activator 10*a*, and spend a greater percentage time in the second regime of instability than the ⅛ sphere activator 10. When in the third regime of instability (riding on the spherical sloped side 22), the ⅛ sphere accelerator 12*a* will be more unstable than the ⅛ sphere activator 10*a*, because the effect of the smaller sphere size outweighs the effect of the greater platform height.

As an alternative or in conjunction with differences in the chart above, the various flat sizes can be selected to increase or decrease the relative amount of instability of each device 10 in the progression. That is, the activators don't all need to use a 2.5 inch flat size, but rather could alternatively have increasing instability by using progressively smaller flat sizes even if all the activators have the same platform height. The same applies for the flat sizes of the accelerators. Workers skilled in the art will understand that all five instability variables (platform height, flat size, initial incline angle, sphere diameter and air pressure) can be selected to provide a progression of increasingly working the desired secondary and tertiary muscles groups.

Figure 10:
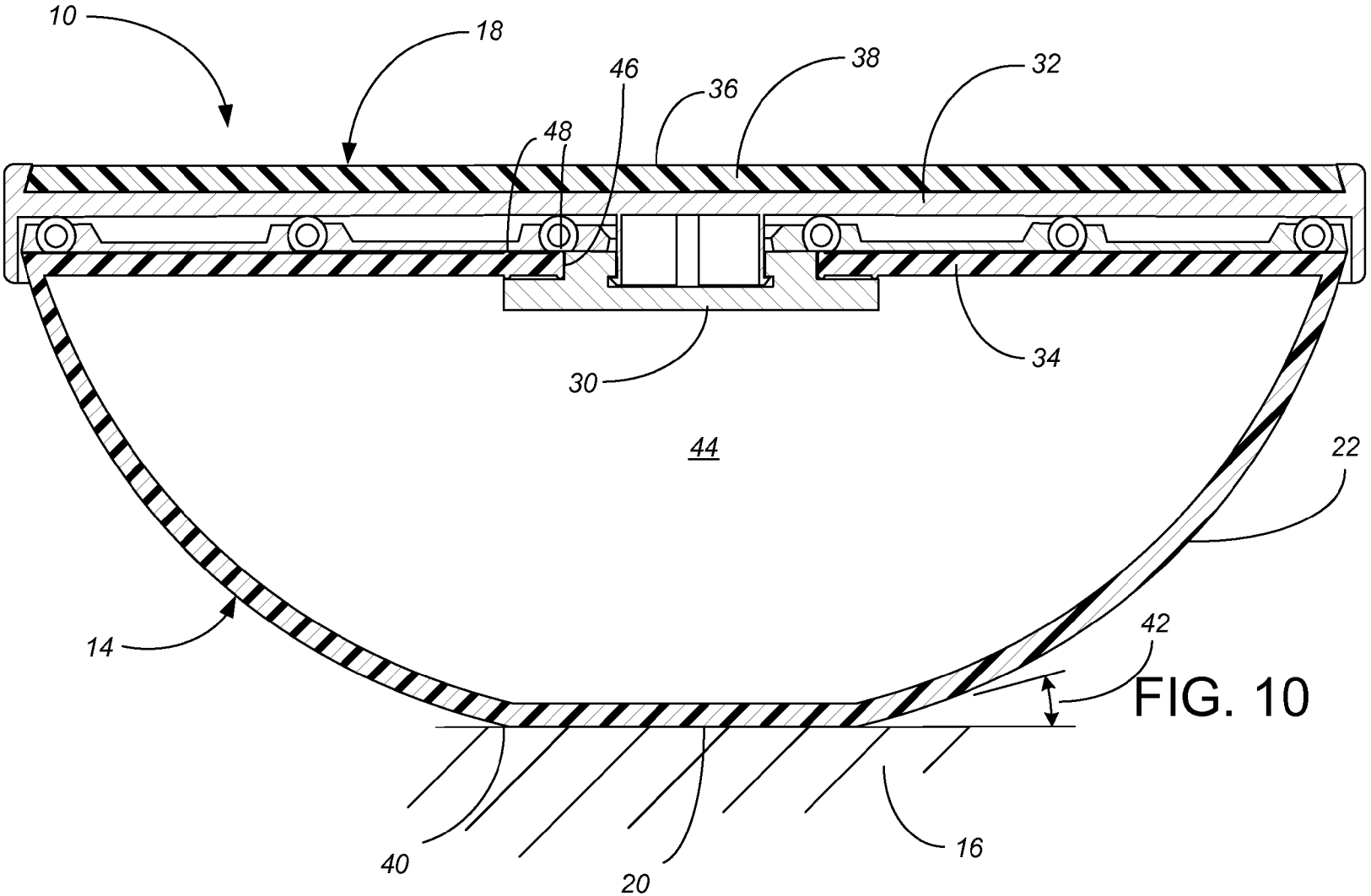
FIG. 10 is a cross-sectional view of an alternative embodiment, similar to FIG. 6 but showing structure to make the top rotatable relative to the base.

The preferred embodiments of the present invention utilize a platform 18 which is rigid and itself provides no degree of instability to the exercise device 10, with the entire instability being derived from compression of the base 14 and tipping or rolling of the base 14 off of the flat 20. Alternatively, the platform can include structure (shown in FIG. 10 using the rotational structure of U.S. Pat. No. 5,479,867 and additionally by incorporation by reference) which permits rotating or turning about the vertical axis 50, such as a lazy susan or turntable type of device. The exact construction to permit rotation within the platform is not particularly significant and can be taken from other rotation devices from the prior art, such as using the turntables disclosed in U.S. Pat. Nos. 1,732,113, 3,302,594, 5,479,867 and 6,854,608, all incorporated by reference. All of these structures would allow the grip surface of the platform to pivot or rotate about the central perpendicular axis 50 of the platform 18.

More preferable than free rotation is a platform which has a force resisting rotation, such as a force within the range of 0.2 to 5 ft-lbs. In other words, the grip surface of the platform should not spin freely, but rather should provide mild resistance to spinning. The mild resistance can be provided against spinning in both clockwise and counterclockwise directions by having a frictional engagement.

Generally, the user can only sustain and control a limited range of twisting motion. For instance, the user's wrist joint and muscles may permit the user to twist the wrist back and forth a maximum of 90°, but not much more. For controlling against instability, generally the beneficial twisting will be constrained within only a few degrees, so as to not risk overtwisting or injury of the joint. More preferable than complete rotation is a platform which permits a swiveling action about a vertical axis 50 toward and away from a center circumferential position, but tends to bias the swiveling action back toward the center circumferential position. Such swivel tops are common in bar stools, for instance. One example of such a swiveling/centering plate structure is disclosed in U.S. Pat. No. 5,779,309, incorporated by reference. The swiveling/centering plate includes a spring which biases the top plate back toward a balanced central (12 o'clock) position. The biasing force of the spring increases as a function of angular displacement from the balanced center point, i.e., the force assisting the user back to the center position is greater when twisting 10° from the center position than when only twisting 5° from the center position. Alternatively, a ramp (not shown) can be used with ball bearings (shown only by incorporation by reference) so gravity assists in biasing the grip surface back to its home (12 o'clock) position. A changing slope of the ramp allows the designer to determine how much force assists the user in returning to the center position for each given amount of twisting.

With a platform that permits either rotation or swiveling about the central vertical axis 50, the objective is to add another degree of instability, so the user exercises secondary muscles to fight against such rotation or swiveling during use of the device 10.

The present invention also contemplates use of the device 10 in a series of stances, postures (poses) and/or exercises to enhance secondary and tertiary muscular development by fighting against the instability permitted by the exercise device 10. In each stance, posture or exercise, a single device 10 is associated with a single appendage of human support. For instance, if the posture is performed with two feet and one hand on the ground, then three different exercise devices 10 work best, one for the left foot, one for the right foot and one for the hand.

Figure 8:
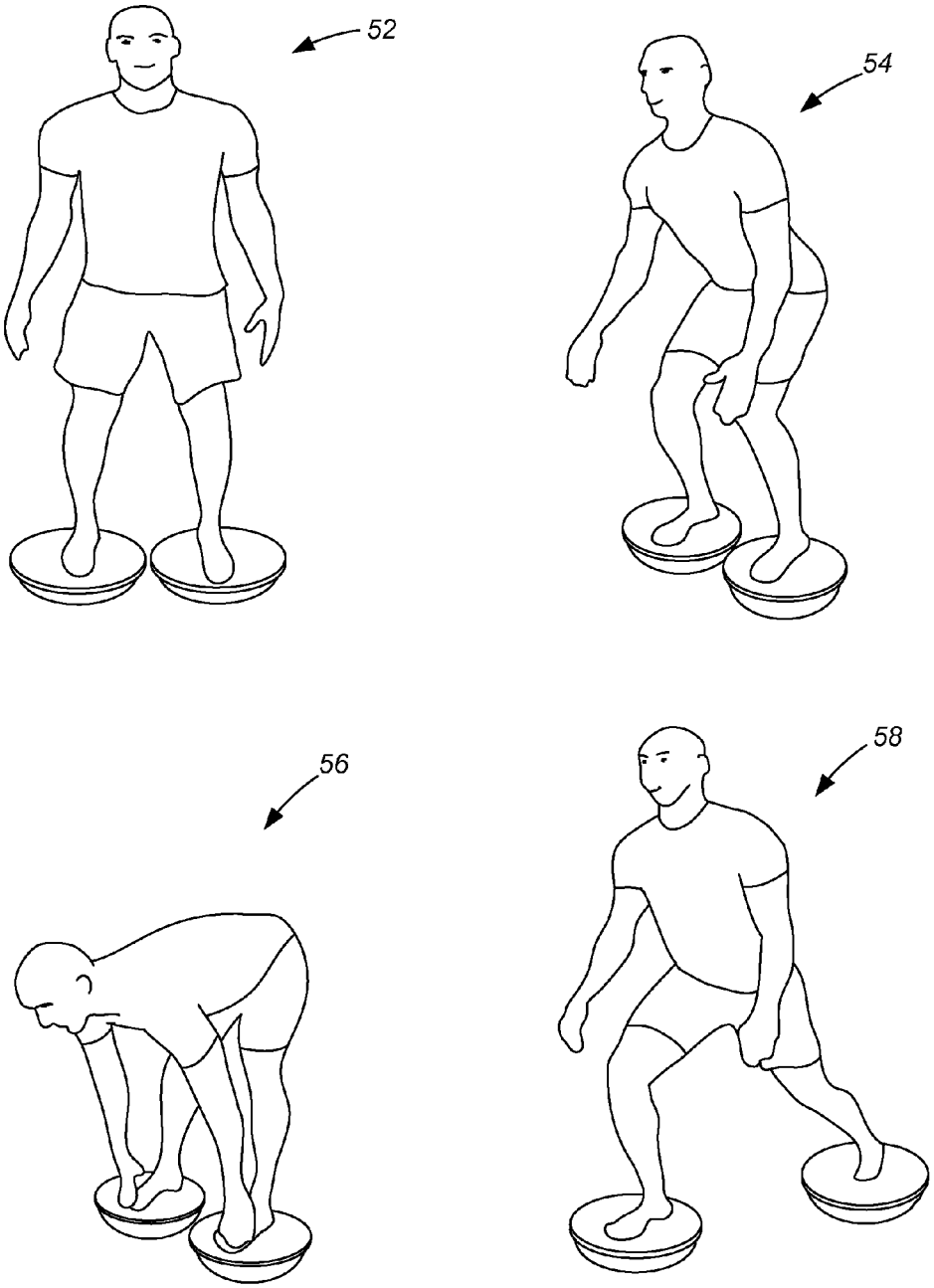
FIGS. 8 and 9 are perspective views showing various stances in using the muscular training devices of the present invention.
Figure 9:
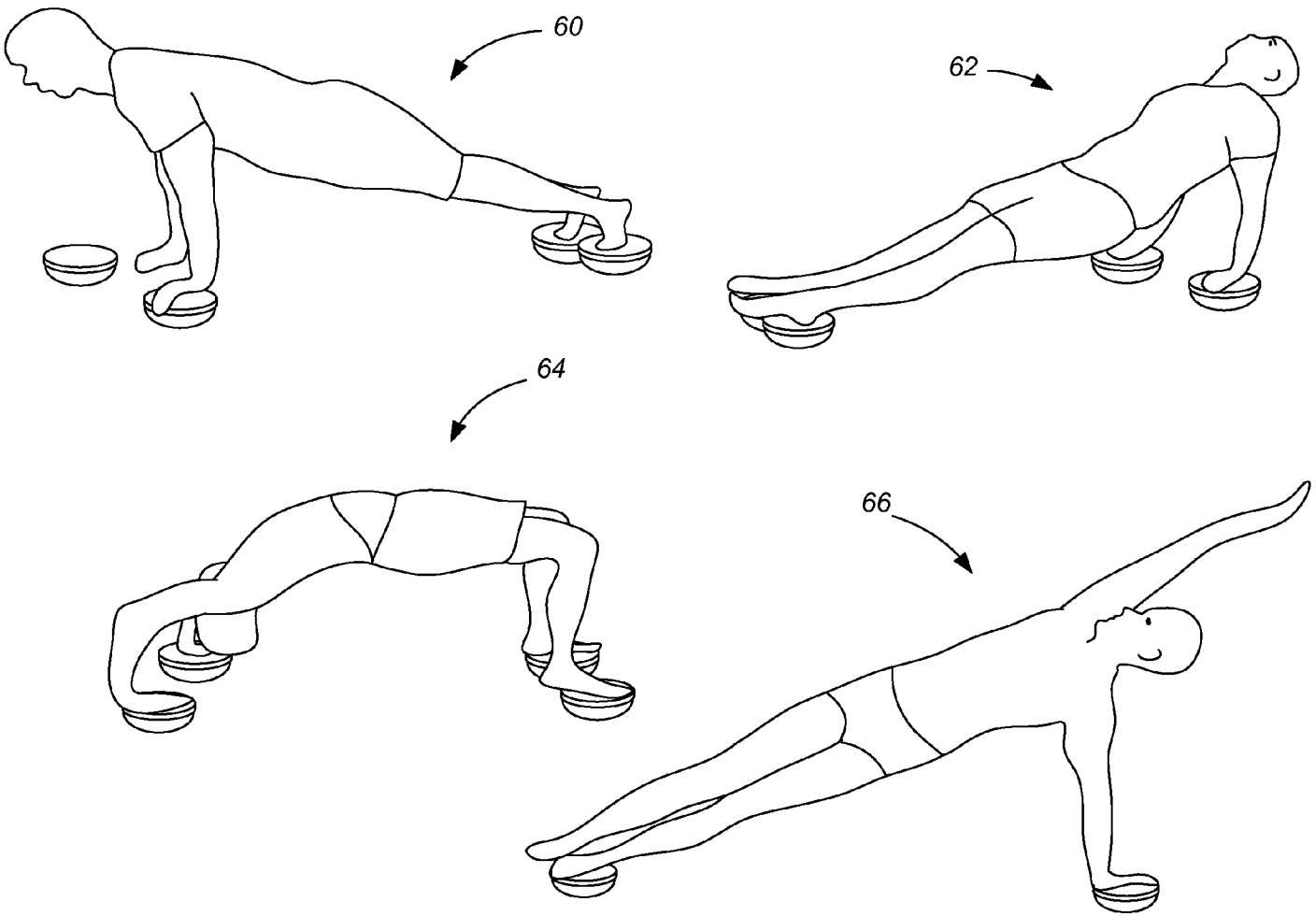

FIGS. 8 and 9 show a variety of different primary postures which can be performed in accordance with the present invention. The eight primary postures shown here are:

1. Standing Posture 52
2. Athletic Posture 54
3. Bow Posture 56
4. Sprinter Posture 58
5. Plank Posture (Downward Facing) 60
6. Bridge Posture (Upward Facing) 62
7. Back Bend Posture (Backward Inversion, which can also be performed over a ball or other support for the back) 64
8. Side Plank 66

In general, an exercise involves moving from a position where the user is supported by the floor 16 to a position/posture wherein all of the user's appendages of stabilizing support are on a different exercise device 10. The mounting onto the exercise devices 10 should be done carefully and slowly, trying to maintain perfect balance and stability. Initially, simply mounting the exercise devices 10 and holding any posture 52, 54, 56, 58, 60, 62, 64, 66 as steadily as possible for 30-45 seconds will help develop the user's secondary and tertiary muscles.

It is recommended that the user demonstrate stability, control and proficiency of each basic posture 52, 54, 56, 58, 60, 62, 64, 66 before progressing to possible variations. In doing so, the participant sets a foundation for maximum success. As the user increases strength and improves balance, it is recommended that she or he appropriately explore and work towards stabilizing at increasingly higher level devices. Each posture 52, 54, 56, 58, 60, 62, 64, 66 also has modifications which are available if the initial basic posture is too difficult. The user may however, progress without having mastered the posture variations. It's only necessary that the user demonstrates proficiency with the postures 52, 54, 56, 58, 60, 62, 64, 66.

Each posture 52, 54, 56, 58, 60, 62, 64, 66 also has options or variations to increase the level of difficulty and challenge. The user may choose for example, to lift an appendage of stabilizing support and balance on one arm or leg. Specifically, instead of performing the "plank posture" which utilizes 4 appendages of support (two hands and two feet), the user may attempt stability and balance with using only 3 appendages of support—like a three legged stool.

While in any of the basic postures 52, 54, 56, 58, 60, 62, 64, 66 with each appendage of stabilizing support on a different device 10, the user can perform a large body exercise involving movement of one or more of the following joints: neck, back, shoulder, elbow, wrist, fingers, hip, knee, ankle, and toe. Examples of such large body exercises with commonly known names are: push-up, triceps extension (elbow extension), torso twist, knee-in, forward bend (torso flexion), back bend (spinal extension), squat, lunge, calf raise and leg extension. The purpose of the large body movement is only a small part for the large, intentional muscle movement involved, and a much larger part to achieve the quick, unconscious muscle firing required to maintain balance and stability during the large body movement.

To further add challenge and increase strength, the user may add load—some form of external weight—to the exercise "action" sequence. For example—if the user previously selected and proficiently performed a squat for the "action," the user would now perform that same exercise using an external load or weight. Typical gym devices can be used to provide the added load, such as dumbbells, kettle bells/Kor bells, medicine balls, Olympic bars/body bars, or a weight vest.

The method of the present invention works by triggering the Golgi tendon receptor and the muscle spindle receptor. During use of the device 10, the body responds by unconsciously firing off additional muscles that are not adequately used during most large body exercise regimens. The present invention seeks to neurologically synchronize, stimulate, innervate, and recruit nearly all of the muscles within the human body. This reaction tends to lead towards a host of many positive benefits, including improved strength, muscle size, and joint stability.

Although the present invention has been described with reference to preferred embodiments, workers skilled in the art will recognize that changes may be made in form and detail without departing from the spirit and scope of the invention.

The invention claimed is:

1. An exercise device sized for a single appendage of human support, comprising:

a compressible base, the base having a horizontally-extending central flat for maintaining a balanced, upright position of the exercise device before being loaded, the base having at least one side encircling the central flat which slope outward and upward around the central flat with a slope which increases as distance from the central flat increases, the sides permitting simultaneous pitch and roll instability to the exercise device at a beginning slope immediately adjacent the central flat of less than 45°; and a relatively rigid platform joined to and horizontally covering the compressible base at a height no greater than 10 inches over a bottom surface of the flat, the platform having a shape which provides substantially equal pitch and roll instability, the platform having an exposed, flat top providing a flat surface sized for a single appendage of human support and at least 3 inches wider than the central flat, wherein the platform comprises an interchangeable grip surface on a plate, the grip surface having a different material, different amount of compressibility or different surface finish than the plate.

2. The exercise device of claim 1, wherein the central flat of the compressible base is circular and has a diameter within the range of 1 to 4 inches before being loaded, and wherein the platform is circular with a diameter from 4 to 16 inches.

3. The exercise device of claim 2, wherein the sides of the compressible base are spherical.

4. The exercise device of claim 1, wherein the compressible base is formed by an air-filled bladder in a flexible rubberized material.

5. The exercise device of claim 4, wherein air bladder is filled with air pressure within the range of 2 to 20 psi.

6. The exercise device of claim 1, wherein the platform comprises a top rotatable relative to the base about a central perpendicular axis of the platform.

7. The exercise device of claim 6, wherein the top provides a rotation resistance within the range of 0.2 to 5 ft-lbs.

8. The exercise device of claim 6, wherein the top provides a rotation resistance which increases as a function of angular displacement from a balanced center point.

9. The exercise device of claim 1, wherein the platform is circular with a diameter within the range of 4 to 16 inches.

10. The exercise device of claim 1 provided as a part of a progression of such exercise devices, with each exercise device in the progression having a different size of central flat before being loaded.

11. The exercise device of claim 1 provided as a part of a progression of such exercise devices, with each exercise device in the progression having a different beginning slope immediately adjacent the central flat before being loaded.

12. The exercise device of claim 1 provided as a part of a progression of such exercise devices, with each exercise device in the progression having a different height of the platform over the flat before being loaded.

13. A method of exercising comprising:

placing a single appendage of human support on an exercise device, the exercise device comprising:

a compressible base, the base having a horizontally-extending central flat for maintaining a balanced, upright position of the exercise device before being loaded, the base having at least one side encircling the central flat which collectively slope outward and upward around the central flat with a slope which increases as distance from the central flat increases, the at least one side permitting simultaneous pitch and roll instability to the exercise device at a beginning slope immediately adjacent the central flat of less than 45°; and a relatively rigid platform joined to and horizontally covering the compressible base at a height no greater than 8 inches over a bottom surface of the flat, the platform having an exposed, flat top providing a flat surface sized for a single appendage of human support, wherein the platform comprises an interchangeable grip surface on a plate, the grip surface having a different material, different amount of compressibility or different surface finish than the plate;

performing a large body exercise while maintaining balance on the exercise device;

interchanging the grip surface with a second interchangeable grip surface; and thereafter performing a second large body exercise while maintaining balance on the exercise device.

14. The method of claim 13, wherein at least two such exercise devices are used during the large body exercise, each for a different appendage of human support.

15. The method of claim 13, wherein the large body exercise is performed using a posture selected from the group consisting of:

standing posture;
athletic posture;
bow posture;
sprinter posture;
plank posture (downward facing);
bridge posture (upward facing);
back bend posture (backward inversion); and
side plank posture.

16. The method of claim 13, wherein the large body exercise involves movement of one or more joints selected from the group consisting of:

neck;
back;
shoulder;
elbow;
wrist;
fingers;
hip;
knee;
ankle; and
toe.

17. An exercise device sized for a single appendage of human support, comprising:

a compressible base which, when positioned on a horizontal floor maintains a balanced, upright position of the exercise device, the base when compressed by body weight permitting simultaneous pitch and roll instability to the exercise device by having a majority of its surface generally in the shape of a spherical section; and a relatively rigid platform joined to and horizontally covering the compressible base at a height no greater than 10 inches over a bottom surface of the base, the platform having a shape which provides substantially equal pitch and roll instability, the platform having an exposed, flat top providing a flat surface sized for a single appendage of human support, wherein the top is rotatable relative to the base about a central perpendicular axis of the platform;

wherein the exposed, flat top is circular with a diameter within the range of 4 to 16 inches and the platform comprises an interchangeable grip surface on a plate, the grip surface having a different material, different amount of compressibility or different surface finish than the plate.

18. The exercise device of claim 17 provided as a part of a progression of such exercise devices, with each exercise device in the progression having a different height of the platform over the bottom surface of the base before being loaded.

* * * * *